US008277341B1

(12) United States Patent
Vignola

(10) Patent No.: US 8,277,341 B1
(45) Date of Patent: Oct. 2, 2012

(54) BUNTING PRACTICE BAT

(75) Inventor: Gary T. Vignola, Livermore, CA (US)

(73) Assignee: Gary T. Vignola, Livermore, CA (US)

( * ) Notice: Subject to any disclaimer, the term of this patent is extended or adjusted under 35 U.S.C. 154(b) by 48 days.

(21) Appl. No.: 12/771,152

(22) Filed: Apr. 30, 2010

(51) Int. Cl.
*A63B 69/00* (2006.01)

(52) U.S. Cl. ..... 473/457

(58) Field of Classification Search ..... 473/457, 473/519, 520, 564–568
See application file for complete search history.

(56) References Cited

U.S. PATENT DOCUMENTS

| | | | | | |
|---|---|---|---|---|---|
| D187,033 | S | | 1/1960 | Dunn et al. | |
| 3,104,876 | A | * | 9/1963 | Salsinger | 473/568 |
| 3,115,342 | A | | 12/1963 | Webster | |
| 3,122,365 | A | * | 2/1964 | August | 473/453 |
| 3,206,195 | A | * | 9/1965 | Myers | 473/457 |
| 3,246,894 | A | * | 4/1966 | Salisbury | 473/457 |
| 3,268,226 | A | | 8/1966 | Martino | |
| 4,214,751 | A | * | 7/1980 | Simpson | 473/457 |
| D259,501 | S | | 6/1981 | Salisbury | |
| 4,768,785 | A | | 9/1988 | Patterson | |
| 5,190,829 | A | | 3/1993 | Nybye | |
| 5,269,511 | A | * | 12/1993 | Chavez | 473/457 |
| D351,868 | S | | 10/1994 | Pendergast | |
| D352,081 | S | * | 11/1994 | Shelley | D21/729 |
| D357,289 | S | * | 4/1995 | Cramton | D21/725 |
| D358,859 | S | * | 5/1995 | Bernardo | D21/725 |
| 5,415,398 | A | | 5/1995 | Eggiman | |
| 5,456,461 | A | | 10/1995 | Sullivan | |
| D397,385 | S | * | 8/1998 | LaBorde et al. | D21/725 |
| 6,241,629 | B1 | | 6/2001 | Otto | |
| 6,425,836 | B1 | | 7/2002 | Misono et al. | |
| 6,565,462 | B1 | * | 5/2003 | Gregg | 473/457 |
| 7,041,017 | B1 | * | 5/2006 | Carfo | 473/457 |
| D543,251 | S | | 5/2007 | Kelliher | |
| 7,585,235 | B2 | | 9/2009 | Misono et al. | |
| 7,935,008 | B2 | * | 5/2011 | Magno | 473/457 |
| 7,985,147 | B1 | * | 7/2011 | Allen | 473/457 |
| 2003/0134698 | A1 | | 7/2003 | Clark et al. | |
| 2007/0173357 | A1 | * | 7/2007 | Mauer et al. | 473/457 |
| 2008/0039241 | A1 | | 2/2008 | Pope | |
| 2009/0191986 | A1 | * | 7/2009 | Bohm | 473/457 |
| 2009/0325736 | A1 | * | 12/2009 | Carsello | 473/457 |
| 2009/0325737 | A1 | * | 12/2009 | Windsor | 473/457 |
| 2010/0311525 | A1 | * | 12/2010 | Cornford et al. | 473/457 |
| 2011/0070980 | A1 | * | 3/2011 | Doherty | 473/457 |

FOREIGN PATENT DOCUMENTS

| | | |
|---|---|---|
| CA | 2306036 | 4/2000 |
| WO | PCT/JP1999/003723 | 4/2000 |

OTHER PUBLICATIONS

"Flat Bunting Tool", 2007. Innovators' Resource Network, Promoting Innovation, Enterprise, and Invention, Feb. 4, 2009, Tom Kelliher, Buntdown Baseball Training Bat, pp. 1, http://www.irnetwork.org/IRNSpeakers.htm.

Collegiate Baseball, The Voice of Amateur Baseball, vol. 61, No. 2, Jan. 26, 2008, 4 pages (see p. 2).

* cited by examiner

*Primary Examiner* — Mark Graham

(74) *Attorney, Agent, or Firm* — Blakely, Sokoloff, Taylor & Zafman, LLP

(57) ABSTRACT

An apparatus is described that includes a bat handle and a bunt element within a region of space extending from the baseball bat handle where a meat portion of a bat would exist if the bat handle was part of a baseball or softball bat. The bunt element has solid material in a first location of the region of space that is struck by a pitched ball that first meets the region of space within a bunt window on the region of space. The bunt element has empty space in a second location of the region of space that is struck by a pitched ball that first meets the region of space outside the bunt window.

8 Claims, 7 Drawing Sheets

BUNTING PRACTICE BAT

BACKGROUND

In the sport of baseball or softball, bunting is a special skill that is difficult to master. Even at the professional level, full time coaching staffs have been known to rely on an outside bunting specialist to teach bunting skills during spring training.

Bunting requires a degree of hand-eye coordination that is comparable to (and possibly even exceeds that) of hitting a baseball or softball. A bunt is most often used to advance a base runner by placing a (bunted) ball with a dampened velocity along one of the base lines. The low velocity in combination with the deliberate placement causes the ball to linger within the infield a maximum distance away from the fielders who are responsible for fielding it. The fielders must therefore run a significant distance in order to field the ball which gives the base runner sufficient time to safely reach the next base.

As observed in FIG. 1A, according to one technique, bunting involves a correctly positioned batter stabbing downward at the ball toward one of the base lines. The downward motion of the bat causes the ball to hit the ground at a steep angle which dampens the speed of the ball. In order to successfully bunt the ball (in either the manner described above or an alternative manner), ideally, the ball first makes contact with the bat within a window (hereinafter the "bunt window") on the bat surface. As observed in FIGS. 1B and 1C the window 101 is centered approximately: 1) along the length axis (y) of the bat, off the tip end of the bat within the "meat" end of the bat; and, 2) along the width axis ($\chi$) of the bat surface facing the field of play, in the middle of the bat. The precision at which the batter attempts to place the bat is apparent from FIG. 1C. Here, even if the batter is successful at the lengthwise placement of the bat such that the ball hits the "meat" of the bat, if the batter places the bat too high, the ball will strike the ground at too sharp an angle 102 (which would effectively stop the ball rather than dampen its speed), or, if the batter places the bat too low, the ball will project upward 103 for an easy fly-out (that fails to advance the runner). Placing the bat such that the ball strikes the bunting window causes the ball to strike the ground at, for example, appropriate angles 101A and/or 101B.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Disclosed herein are various embodiments of a practice device for developing a player's bunting skills. A perspective on the various embodiments disclosed herein is that the practice device should be shaped like a baseball bat in various respects yet have modifying features that force the player to focus his/her hand-eye coordination to the positioning and timing needed to bunt correctly. Continued use should result in the player eventually developing a natural feel for proper bunting.

Figure 1A:
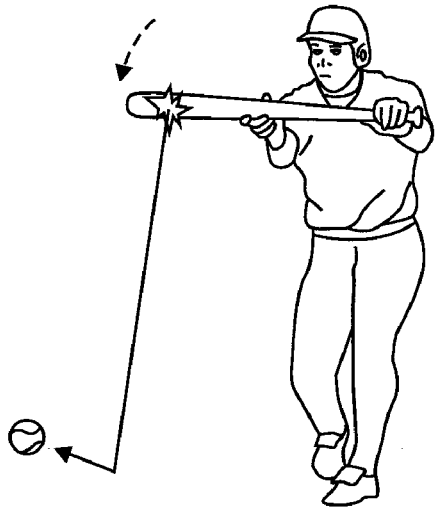
FIGS. 1A-C show various aspects of bunting.
Figure 1B:
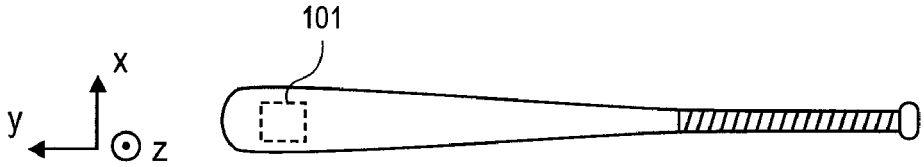
Figure 1C:
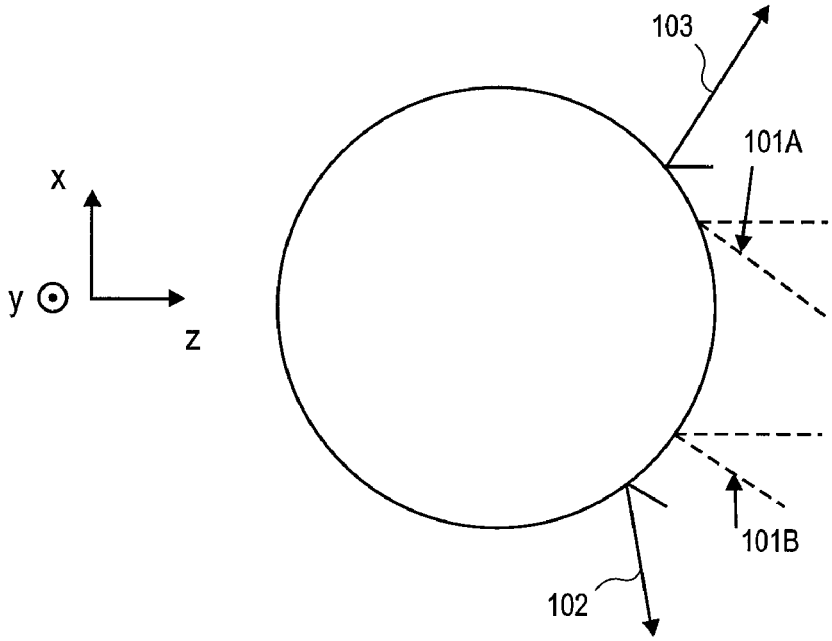
Figure 2A:
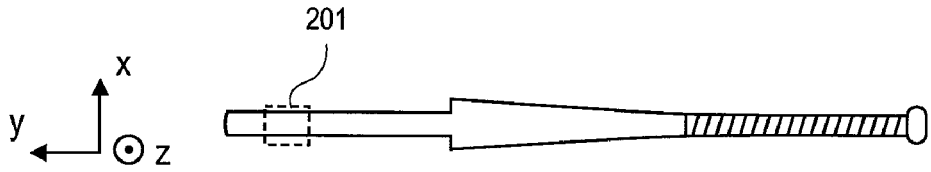
FIGS. 2A-C show a first embodiment of a bunting practice bat.
Figure 2B:
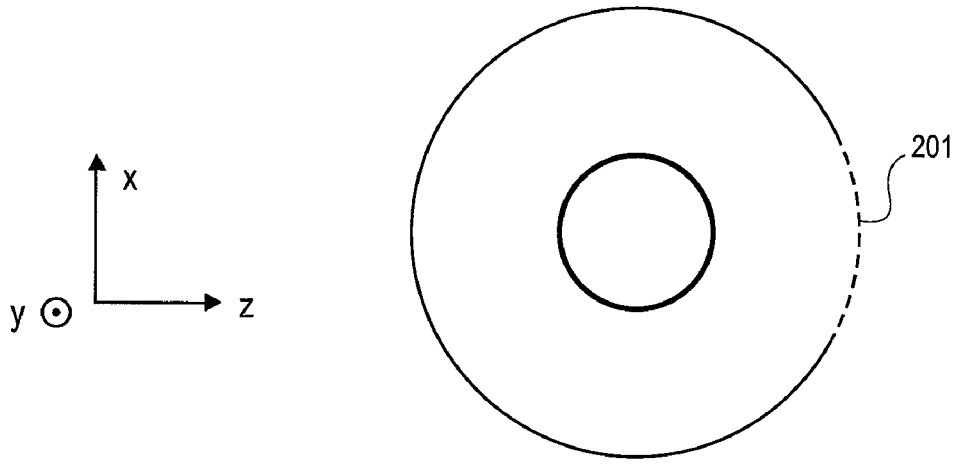
Figure 2C:
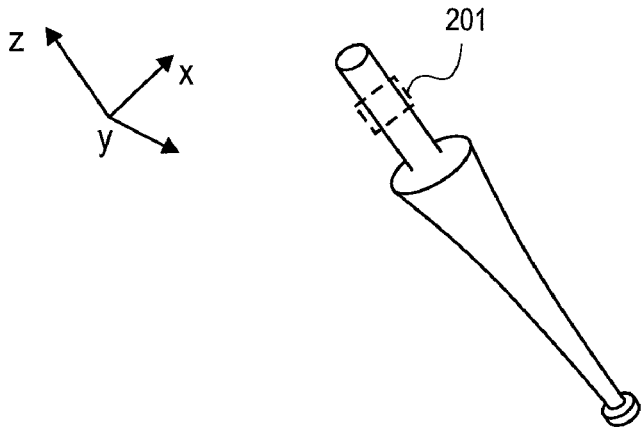

An example of a first embodiment is observed in FIGS. 2A,B,C. As observed, the practice bat has many features of a typical baseball or softball bat in terms of the shape of the handle extending out toward the region 201 of the aforementioned "bunt window" on the bat where a successfully bunted ball is supposed to hit the bat. At the region of the bunt window 201, however, the bat is modified with a structure ("bunt element") designed to result in a solid hit on the ball only if the batter has positioned the bat correctly.

Figure 3A:
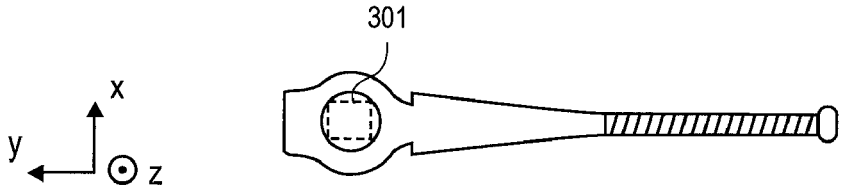
FIGS. 3A-C show a second embodiment of a bunting practice bat
Figure 3B:
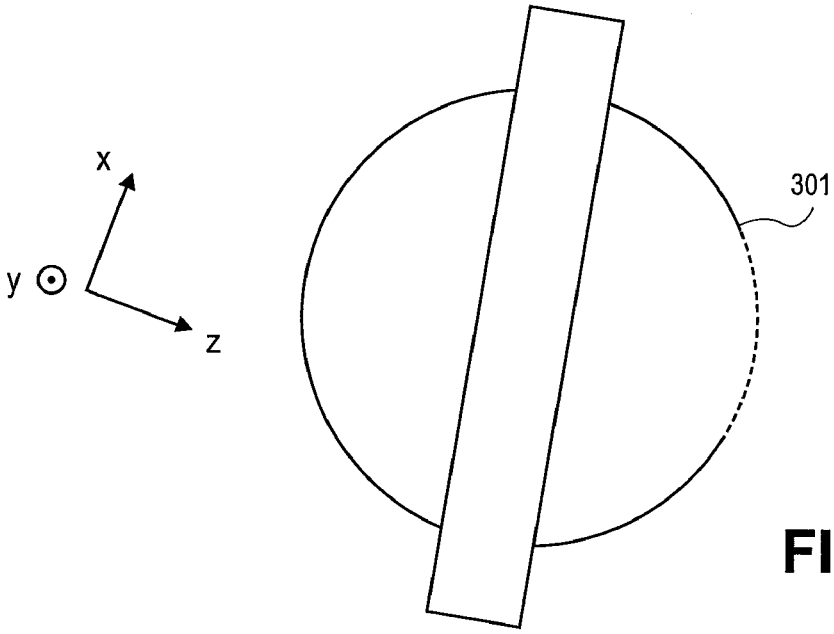
Figure 3C:
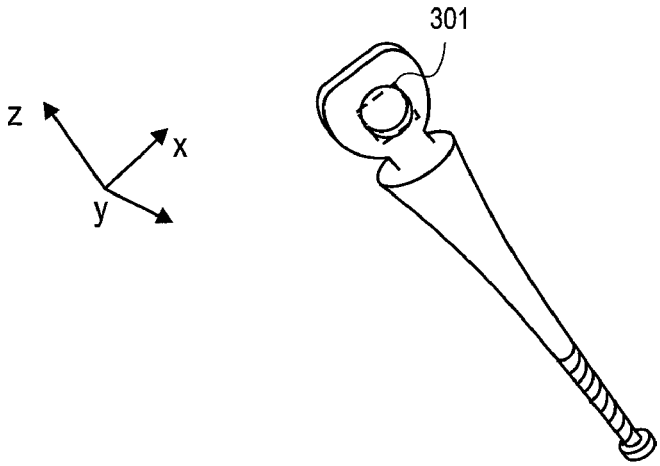

FIGS. 3A,B,C show another embodiment designed with a bunt element whose feedback mechanism is inverse to the mechanism described just above. That is, the bunt element includes, at the region of the bunt window 301, a hole that is placed to result in a "miss" on the ball if the batter has positioned the bat correctly.

In either of the embodiments above, the batter is given pronounced feedback with respect to the position of the bat ("hit" or "miss") that causes the batter to better focus his/her hand-eye coordination concerning the placement of the bat while bunting. For instance, a player being developed with the practice bat of FIGS. 2A,B,C may, at first, fail to make little if any contact with a series of pitched balls. Over time, however, with repeated pitches, the player should eventually learn/develop where the bat needs to be positioned in order to make solid contact with the ball. Development of this skill should translate into successful bunts with a real baseball or softball bat.

Likewise, if the practice bat of FIGS. 3A,B,C is used, the player may fail to miss the ball at first. But with practice, the player will learn where the bat needs to be positioned in order to miss the ball. Development of this skill should, again, automatically translate into successful bunts with a real baseball bat or softball bat.

Figure 4A:
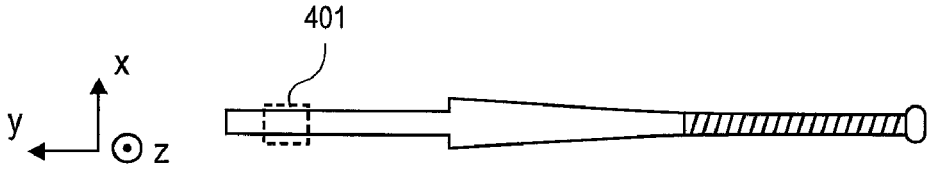
FIGS. 4A-C shows a third embodiment of a bunting practice bat.

Various practice bat embodiments can be implemented with either or both of the two approaches described above. FIGS. 4A,B,C show the bunt element of FIGS. 2A,B,C modified to better replicate the surface area of the bunt window 401 as it exists on an actual baseball bat or softball bat.

Figure 5A:
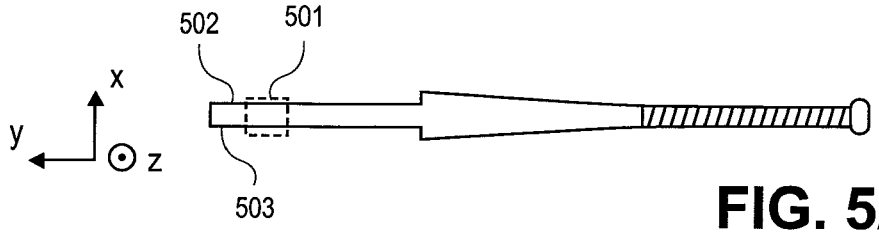
FIGS. 5A-C shows a fourth embodiment of a bunting practice bat.
Figure 5B:
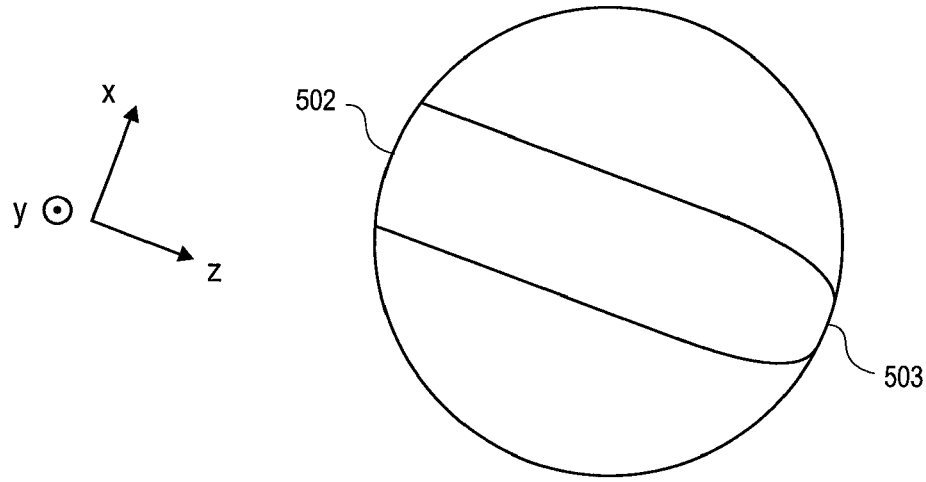
Figure 5C:
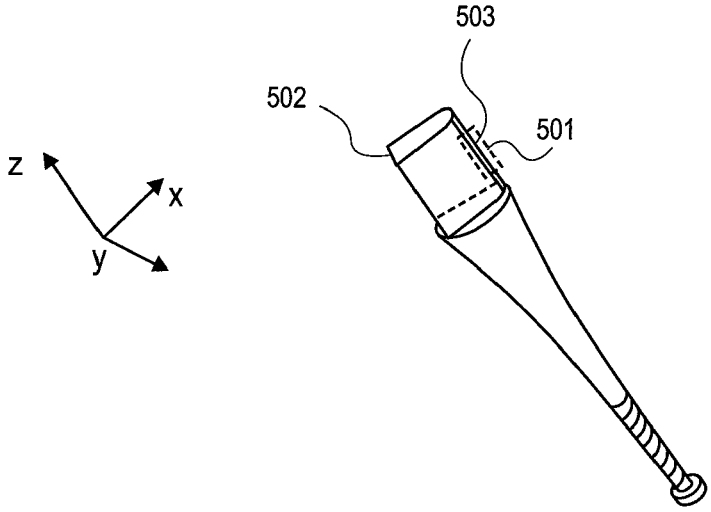

FIGS. 5A,B,C show the bunt element embodiment of FIGS. 4A,B,C with one of the edges 502 being "full width" to give the batter a wider surface area to make contact with (the edge may be rounded as observed in FIGS. 4A,B,C, or, for example, squared off) and the other of the edges 503 being "tapered" to give the batter a thinner surface area to make contact with. Here, for example, when initially using the practice bat as a development tool, the player may use the wider edge 502 to "coarsely" develop his/her bat placement skills. Once the player has become proficient at making contact with wider edge 502, the player may then begin to use the narrowed edge 503 to "finely" develop his/her bat placement skills.

Figure 4B:
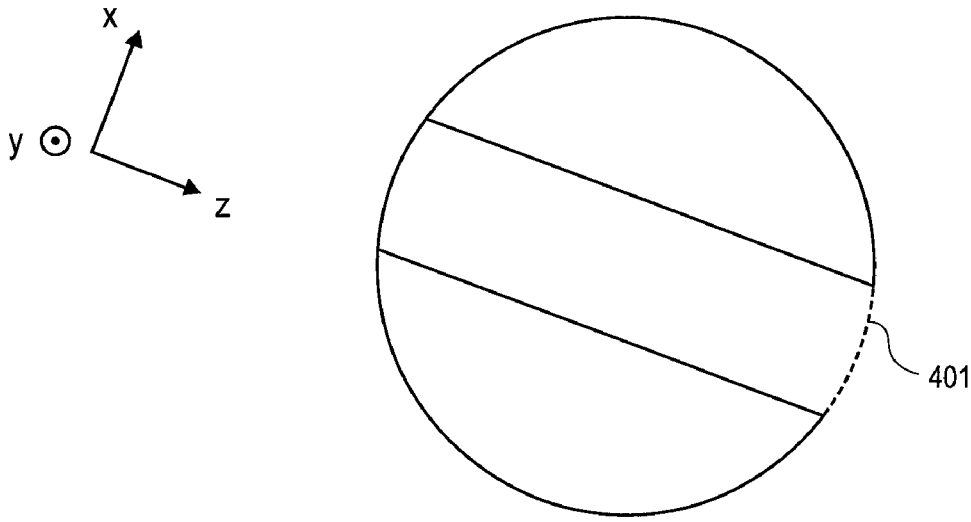
Figure 4C:
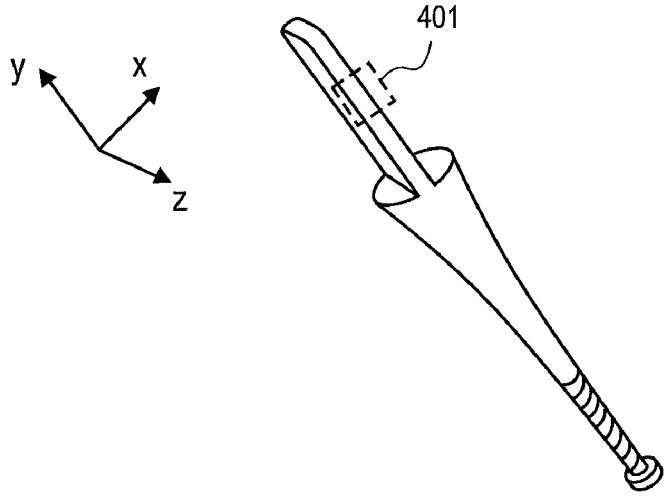
Figure 6A:
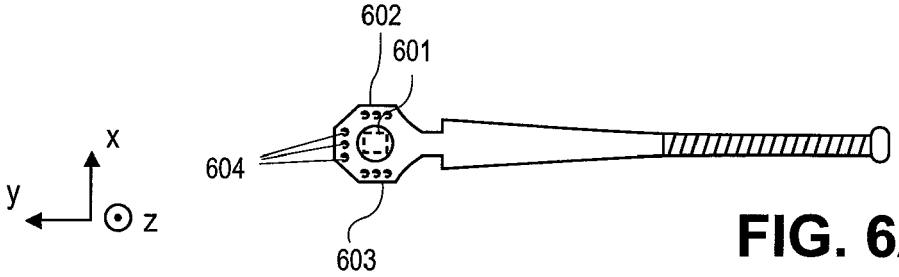
FIGS. 6A-C shows a fifth embodiment of a bunting practice bat.
Figure 6B:
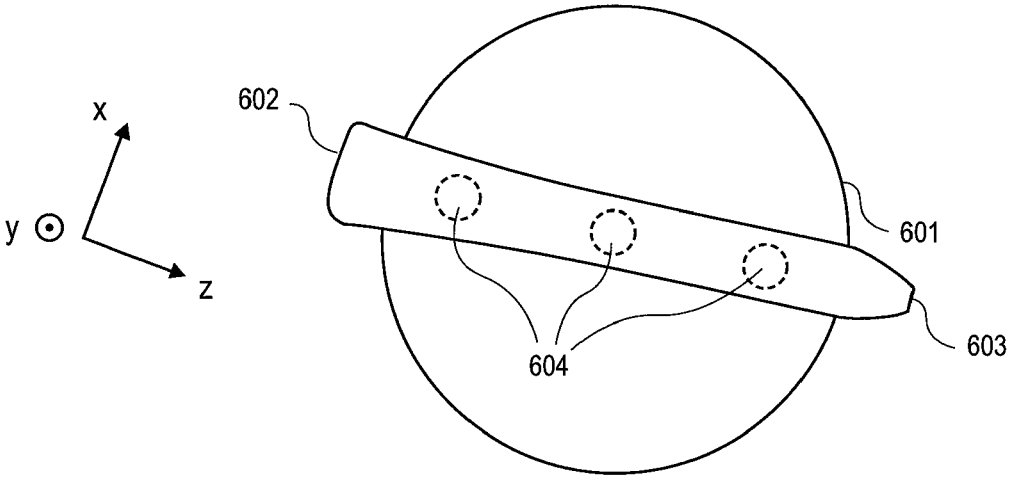
Figure 6C:
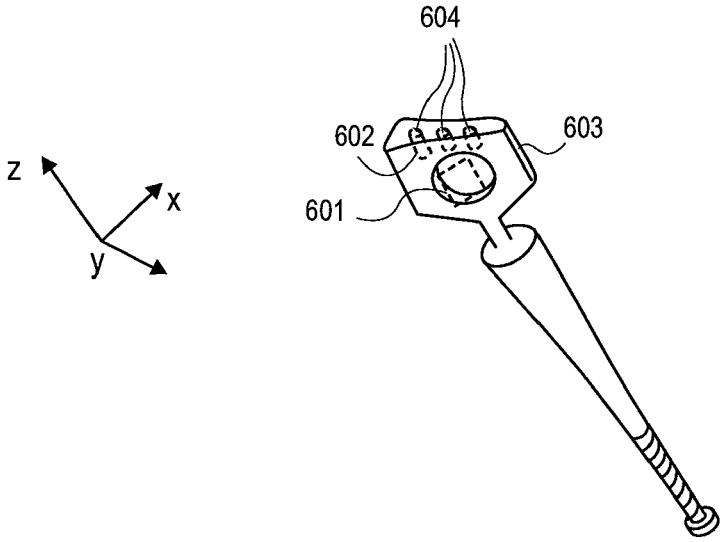

FIGS. 6A,B,C show a combined approach that integrates the design approach of FIGS. 5A,B,C with the design approach of FIGS. 3A,B,C. Here, three different learning styles can be attempted with a single bat design. Depending on how the player orients the bat relative to the pitched ball, the player can coarsely develop his/her bat position with the wide edge 602, finely develop his/her bat positioning with the narrowed edge 603, or, use a "miss" rather than "hit" feedback approach by attempting to "miss" the ball through the hole 601. Notably, for the particular example of FIGS. 6A, B, C, edges 602, 603 extend beyond the barrel of the bat. In an alternative embodiment, the edges may lie on a surface that corresponds to a normal bat barrel such as the edges observed in FIG. 4B.

FIGS. 6A,B,C also show that differently shaped edges may be used for "fine" development. That is, for example, whereas FIGS. 5A,B,C show a rounded narrowing edge, FIGS. 6A,B,C show a more linearly narrowing edge. Here, any narrowing of an edge, when viewing a cross section of the bat perpendicular to its length axis, may be referred to as tapered. Thus, various tapered shapes may exist such as rounded, linear, etc.

FIGS. 6A,B,C also show the placement of slugs 604 within the practice bat. The slugs 604 are meant to give the bat approximately normal weight and balance given its length (e.g, so the "pull" felt by the batter is approximately the same as the pull the batter would feel for a normal bat of same length). As the various features described herein may correspond to less bat mass as compared to a similarly sized unmodified normal bat, the presence of slugs 604 act to compensate for the loss of mass. Other approaches may also be undertaken to compensate for such lost mass in the alternative or in combination to slugs. For instance, a sheet of dense material may be specially cut and affixed to a certain region (e.g., the end region) of the bunt element to compensate for the lost mass and provide for approximate balance and weight of a normal bat. A perhaps even simpler approach is to attach a disk at the end of the practice bat to give the bat the proper balance and weight compensation. Disks are discussed in more detail further below.

Figure 7:
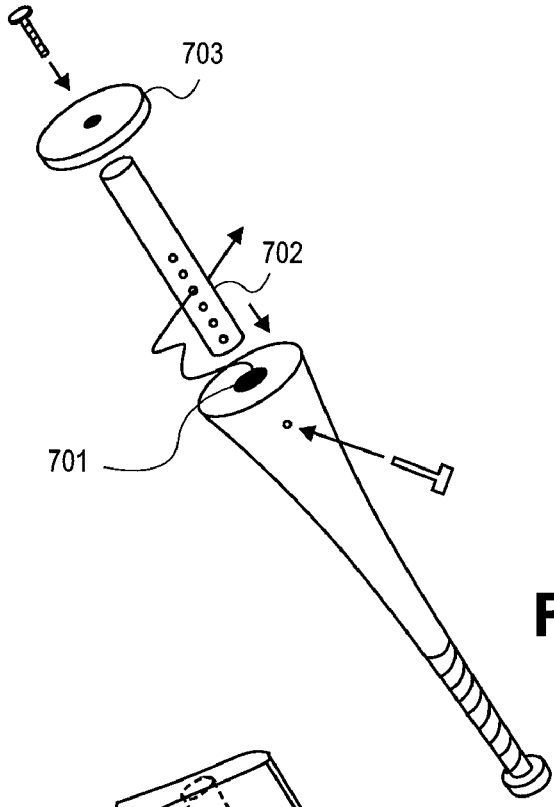
FIG. 7 shows a sixth embodiment of a bunting practice bat.

FIG. 7 shows a practice bat having an adjustable "window' position. Here, for instance, as different players have different bat lengths, it may not be cost effective (e.g. for a baseball or softball team) to have different practice bats of different corresponding bat lengths. As such, the bunt element of the practice bat of FIG. 7 can be adjustably positioned along the bat's length. By adjusting the bunt element to different positions along the bat's lengthwise axis, a single bat can be used to train a number of different players having a range of different bat length preferences. According to the embodiment of FIG. 7, the handle portion has a hollowed region 701 in which a guide member 702 of the bunt element slides in order to effect a particular effective bat length. Here, a particular bat length is established by setting one or more pegs through one or more pre set holes in the handle and one of the holes along the guide of the bunt element.

Figure 8:
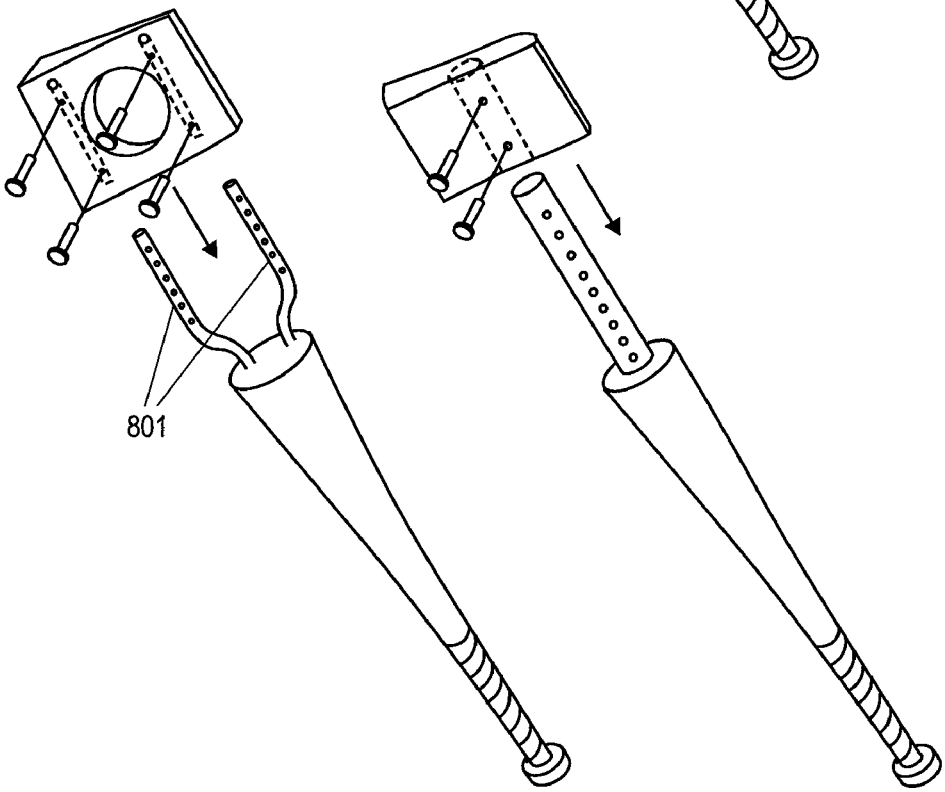
FIG. 8 shows a seventh embodiment of a bunting practice bat.

FIG. 8 shows an alternate approach in which the handle has one or more fixed guides 801 along which the bunt element slides in order to effect a particular bat length. Here, the one or more guides 801 have a number of holes for establishing different effective bat lengths and the bunt element has one or more preset holes in which to insert corresponding pegs into the guide(s). Different weights/slugs may be needed to produce the proper weight and balance for each different length. Here, as just one approach, a collection of disks may be made available, where, each disk has a different weight to produce the correct weight/balance for a specific effective bat length. As observed back in FIG. 7, a particular disk 703 (or particular combination of disks) is attached to the end of the bunt element with (such as with a threaded bolt that threads into a weight mount fixture (e.g., a threaded opening) that is fixed into the end of the bunt element 702) to effect the correct weight and balance for a particular bat length.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

I claim:

1. An apparatus, comprising:

a bat handle; and a bunt element within a region of space extending from said bat handle where a meat portion of a bat would exist if said bat handle was part of a baseball or softball bat, said bunt element having:

first solid material in a first location of said region of space that is struck by a first pitched ball if the first pitched ball first meets said region of space within a first bunt window on said region of space;

empty space in a second location of said region of space that is struck by a second pitched ball if the second pitched ball first meets said region of space outside said first bunt window;

second solid material in a third location of said region space, said solid material in said third location of said region of space being struck by a third pitched ball if the third pitched ball first meets said region of space within a second bunt window on said region of space that does not overlap said first bunt window;

empty space in a fourth location of said region of space that is struck by a fourth pitched ball if the fourth pitched ball first meets said region of space outside said second bunt window, wherein, there exists less of said first solid material in said first bunt window than said second solid material in said second bunt window.

2. The apparatus of claim 1 further comprising a guide extending from said bat handle along which said bunt element can be positioned to adjust said first bunt window's position.

3. The apparatus of claim 1 wherein said bunt element further comprises a weight mount fixture to attach one or more weights to said bunt element.

4. The apparatus of claim 1 wherein said bunt element includes weight to compensate for weight loss associated with said empty space.

5. An apparatus, comprising:

a bat handle; and a bunt element within a region of space extending from said baseball bat handle where a meat portion of a bat would exist if said bat handle was part of a baseball or softball bat, said bunt element having:

empty space in a first location of said region of space that is struck by a first pitched ball if the first pitched ball first meets said region of space within a first bunt window on said region of space;

first solid material in a second location of said region of space that is struck by a second pitched ball if the second pitched ball first meets said region of space outside said first bunt window;

second solid material in a third location of said region of space that is struck by a third pitched ball if the third pitched ball first meets said region of space within a second bunt window on said region of space;

empty space in a fourth location of said region of space that is struck by a fourth pitched ball if the fourth pitched ball first meets said region of space outside said second bunt window;

third solid material in a fifth location of said region space that is opposite said third location of said region of space, said solid material in said fifth location of said region of space being struck by a fifth pitched ball if the fifth pitched ball first meets said region of space within a third bunt window on said region of space that is opposite said second bunt window on said region of space;

empty space in a sixth location of said region of space that is struck by a sixth pitched ball if the sixth pitched ball first meets said region of space outside said third bunt window, wherein, there exists less of said second solid material in said second bunt window than said third solid material in said third bunt window.

6. The apparatus of claim 5 further comprising a guide extending from said bat handle along which said bunt element can be positioned to adjust said bunt windows' respective positions.

7. The apparatus of claim 5 wherein said bunt element further comprises a weight mount fixture to attach one or more weights to said bunt element.

8. The apparatus of claim 5 wherein said bunt element includes weight to compensate for weight loss associated with said empty spaces.

* * * * *